US009414698B2

(12) United States Patent
Sheeler-Johnson

(10) Patent No.: US 9,414,698 B2
(45) Date of Patent: Aug. 16, 2016

(54) SUPPORTIVE HEAD CRADLE PILLOW TO AID IN BACK SLEEPING AND PROTECT FACIAL SKIN

(71) Applicant: Helene Elizabeth Sheeler-Johnson, Webb City, MO (US)

(72) Inventor: Helene Elizabeth Sheeler-Johnson, Webb City, MO (US)

( * ) Notice: Subject to any disclaimer, the term of this patent is extended or adjusted under 35 U.S.C. 154(b) by 0 days.

(21) Appl. No.: 14/848,538

(22) Filed: Sep. 9, 2015

(65) Prior Publication Data

US 2016/0073803 A1 Mar. 17, 2016

Related U.S. Application Data

(60) Provisional application No. 62/049,700, filed on Sep. 12, 2014.

(51) Int. Cl.
*A47G 9/10* (2006.01)

(52) U.S. Cl.
CPC ..... *A47G 9/10* (2013.01)

(58) Field of Classification Search
CPC ..... A47G 9/10; A47C 7/383; A47C 7/38
USPC ..... 5/640, 636, 637, 630, 622, 621, 655, 5/652; D6/601
See application file for complete search history.

(56) References Cited

U.S. PATENT DOCUMENTS 2,562,725 A * 7/1951 Leto et al. ..... A47C 20/025 5/631
3,911,512 A * 10/1975 Plate ..... A47C 3/16 297/118
4,042,278 A * 8/1977 Jensen ..... A47C 7/383 297/397
4,206,945 A * 6/1980 Kifferstein ..... B60N 2/6036 297/397
5,506,533 A * 4/1996 Wu ..... H03K 3/033 327/172
5,664,271 A * 9/1997 Bellavance ..... A47C 20/025 5/630
D408,676 S * 4/1999 Straub ..... D6/333
D446,675 S * 8/2001 Straub ..... D6/333
6,415,466 B1 * 7/2002 Laiso ..... A47G 9/02 5/482
6,473,923 B1 * 11/2002 Straub ..... A47D 13/08 5/655
6,601,252 B1 * 8/2003 Leach ..... A47C 1/146 5/420
6,928,679 B1 * 8/2005 Gross ..... A47C 20/026 5/638
6,966,087 B2 * 11/2005 Robinette ..... A61F 5/3792 5/625
7,346,949 B2 * 3/2008 Kamrin-Balfour ..... A47C 7/72 5/655
7,386,902 B2 * 6/2008 Wilson ..... A47G 9/10 248/102

(Continued)

*Primary Examiner* — Robert G Santos
(74) *Attorney, Agent, or Firm* — Dunlap Bennett & Ludwig PLLC

(57) ABSTRACT

An incredibly soft, yet supportive, form-fitting head cradle that aids in consistent and comfortable back sleep while eliminating pressure on, or anything touching, your facial skin during sleep. The Back to Beauty™ Anti Wrinkle Head Cradle is a support designed to cradle the head and neck and keep anything from touching facial skin. It is made with a down or alternatively micro fiber materials. It has unique crescent-shaped head supports to deliver the stability and comfort necessary for successful nights sleeping without anything touching the face.

17 Claims, 4 Drawing Sheets

(56) References Cited

U.S. PATENT DOCUMENTS 7,712,169 B2 * 5/2010 Kovalyak ..... A47C 20/026 5/637
D652,239 S * 1/2012 Governale ..... D6/601
D691,828 S * 10/2013 Rosenberg ..... D6/601
8,646,134 B1 * 2/2014 Alletto, Jr. ..... A47G 9/10 5/490
8,856,991 B2 * 10/2014 Edwards ..... A47C 7/383 5/637
8,887,332 B2 * 11/2014 Alletto ..... A47G 9/10 5/490
9,015,883 B2 * 4/2015 Alletto ..... A47G 9/1036 5/490
9,259,091 B2 * 2/2016 Freund ..... A47C 7/383
2004/0244114 A1 * 12/2004 Robinette ..... A61F 5/3792 5/626
2005/0160531 A1 * 7/2005 Gross ..... A47C 20/026 5/636
2006/0010605 A1 * 1/2006 Kamrin-Balfour ..... A47C 7/72 5/655
2007/0094799 A1 * 5/2007 Wilson ..... A47G 9/10 5/655
2007/0163051 A1 * 7/2007 Straub ..... A47D 15/008 5/655
2009/0178202 A1 * 7/2009 Kovalyak ..... A47C 20/026 5/655
2010/0205744 A1 * 8/2010 Edwards ..... A47C 7/383 5/644
2013/0263386 A1 * 10/2013 Romero ..... A47G 9/00 8/137
2014/0096323 A1 * 4/2014 Alletto ..... A47G 9/1036 5/644
2014/0230152 A1 * 8/2014 Wootten, Jr. ..... A47G 9/10 5/645
2014/0317850 A1 * 10/2014 Alletto ..... A47G 9/1036 5/638
2015/0013071 A1 * 1/2015 Freund ..... A47C 7/383 5/639
2016/0073803 A1 * 3/2016 Sheeler-Johnson ..... A47G 9/10 5/640

* cited by examiner

THE USER IDENTIFIES THE TOP OF THE HEAD CRADLE AND PLACES THE CRADLE IN THE POSITION THAT IS MOST COMFORTABLE TO THEM:

- BY ITSELF WITH THE SUPPORT CRESCENTS FACING UPWARD
- ON TOP OF THE USER'S EXISTING PILLOW WITH THE SUPPORT CRESCENTS FACING UPWARD
- BY ITSELF WITH THE SUPPORT CRESCENTS FACING DOWNWARD TO CREATE A "HAMMOCK"
- ON TOP OF THE USER'S EXISTING PILLOW WITH THE SUPPORT CRESCENTS FACING DOWNWARD

↓

THE USER LIES DOWN ON THEIR BACK AND SWEEPS THEIR HAIR AWAY FROM THE NECK, ALLOWING IT TO FLOW OVER THE TOP END OF THE CRADLE

↓

WITH THE HEAD AND HAIR IN PLACE BETWEEN THE SUPPORT CRESCENTS, THE USER GRABS THE BOTTOM CORNERS OF THE BASE OF THE CRADLE AND GUIDES THEM TO REST ON THEIR SHOULDERS

↓

THE USER MOVES THEIR HEAD WITHIN THE CRADLE AND PULLS THE CRESCENTS AWAY FROM THEIR EARS UNTIL THEIR HEAD IS SETTLED AND COMFORTABLE

↓

THE USER SLEEPS COMFORTABLY WITHIN THE PERSONALLY FITTED CRADLE

FIG.7

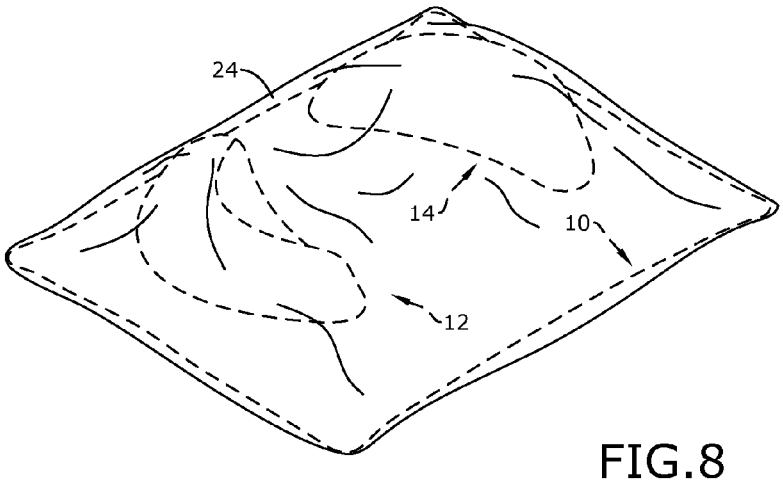

FIG.8

SUPPORTIVE HEAD CRADLE PILLOW TO AID IN BACK SLEEPING AND PROTECT FACIAL SKIN

CROSS-REFERENCE TO RELATED APPLICATION

This application claims the benefit of priority of U.S. provisional application No. 62/049,700, filed Sep. 12, 2014, the contents of which are herein incorporated by reference.

BACKGROUND OF THE INVENTION

The present invention relates to pillows and, more particularly, to pillows for supporting back sleep, where the user sleeps on their back.

Most medical or beauty back sleeping pillows are very rigid and made of a foam material or a foam mold, which compresses to get hard and even warm in temperature. Or, these back sleeping pillows are made of such a flimsy foam material that cannot keep a person's head in place or from falling from side to side during sleep to avoid all parts of facial skin being touched. Other beauty pillows on the market still encourage side sleeping, which puts undesired weight, due to gravity on facial skin.

It is highly desirable keep everything away from your face to maximize the benefits of back sleeping and keep the weight of the head of facial skin. Other pillows to do not facilitate this, particularly in soft pillows which present lateral aspects of the pillow when the user's head compresses the pillow material such that the ends wrap around and touch the wearers face and neck or at least one side of the face.

Other side sleeping beauty pillows either boast a satin material that helps "minimize" wrinkles or they have a shape cut out of the pillow that the user's cheek is intended to fall through, but the weight of the user's head is still compressing many parts of the user's facial skin.

As can be seen, there is a need for a pillow that then creates a solution for exclusive comfortable back sleep, while avoiding contact of the face and facial skin.

SUMMARY OF THE INVENTION

In one aspect of the present invention, a head cradle pillow is provided comprising: a pillow base; and a pair of opposed crescent shaped support members are disposed in a spaced apart relation to define a head cradle on an upper surface of the pillow base. The base pillow may be comprised of a down alternative microfiber material, which is preferably laminated with a down proof material. The crescent shaped support members may also be comprised of a down alternative microfiber material, more preferably the down alternative microfiber material is laminated with a down proof material. The base pillow and crescent shaped support members are covered with a fabric material, and is preferably 100% cotton.

In some aspects of the invention a lower point of the crescent shaped support members are defined proximal to a hair line at the nape of a user's head and an upper point of the crescent shaped support members are defined proximal to the top of a user's head.

These and other features, aspects and advantages of the present invention will become better understood with reference to the following drawings, description and claims.

BRIEF DESCRIPTION OF THE DRAWINGS

FIG. 7: is a flow chart of the intended use of the pillow.

FIG. 8: is a perspective view of an alternate embodiment of the pillow.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a pillow with lateral supports for the sides of a wearer's head that facilitates restful back sleep.

Figure 1:
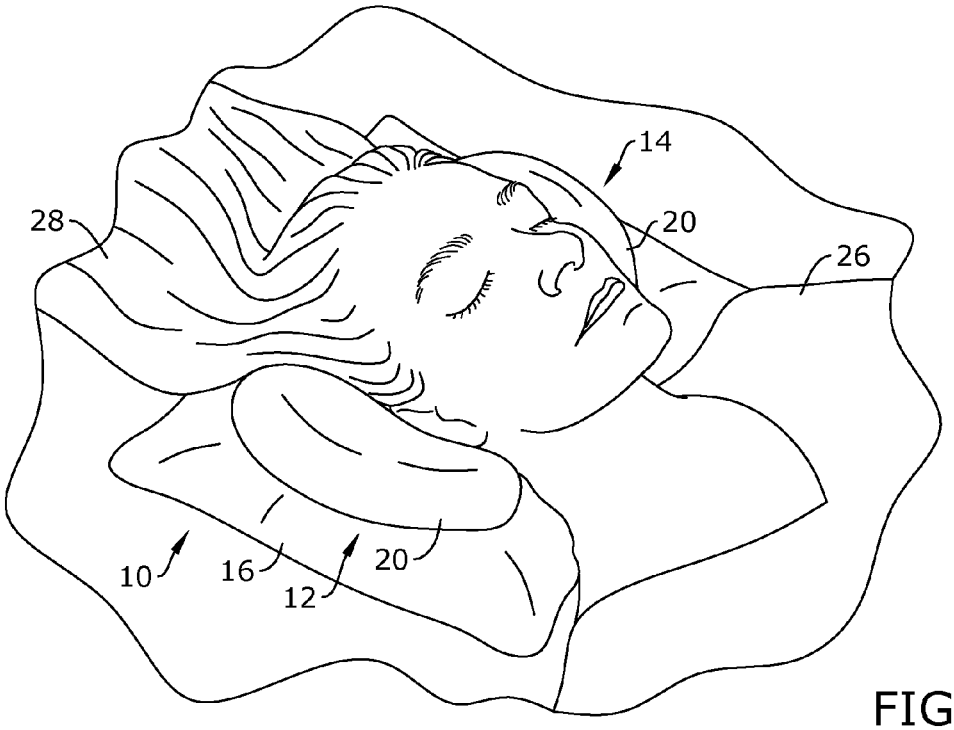
FIG. 1: is a perspective view of the invention, shown in use.
Figure 2:
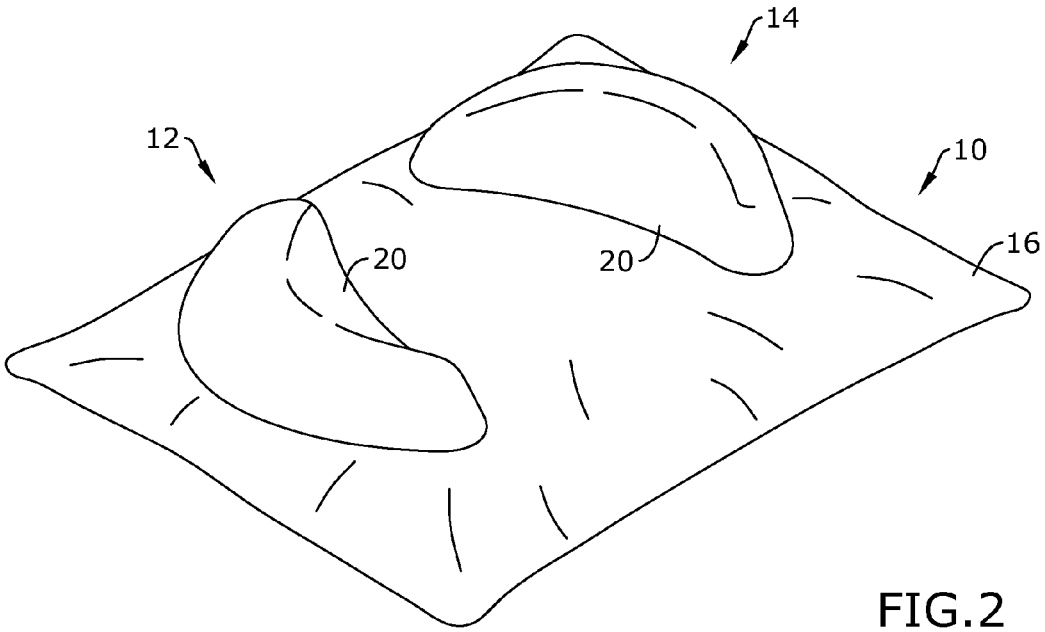
FIG. 2: is a perspective view of an embodiment of the pillow.

As best seen in reference to FIG. 1, a user 26 is depicted resting on an embodiment of a cradle pillow 10 of the present invention. The cradle pillow 10 comprises a left crescent shaped support 12 and a right crescent shaped support 14, disposed in a spaced apart relationship on a top surface of a base pillow 18. The user may drape their hair 28 over the top end of the pillow whilst sleeping or resting.

Figure 3:
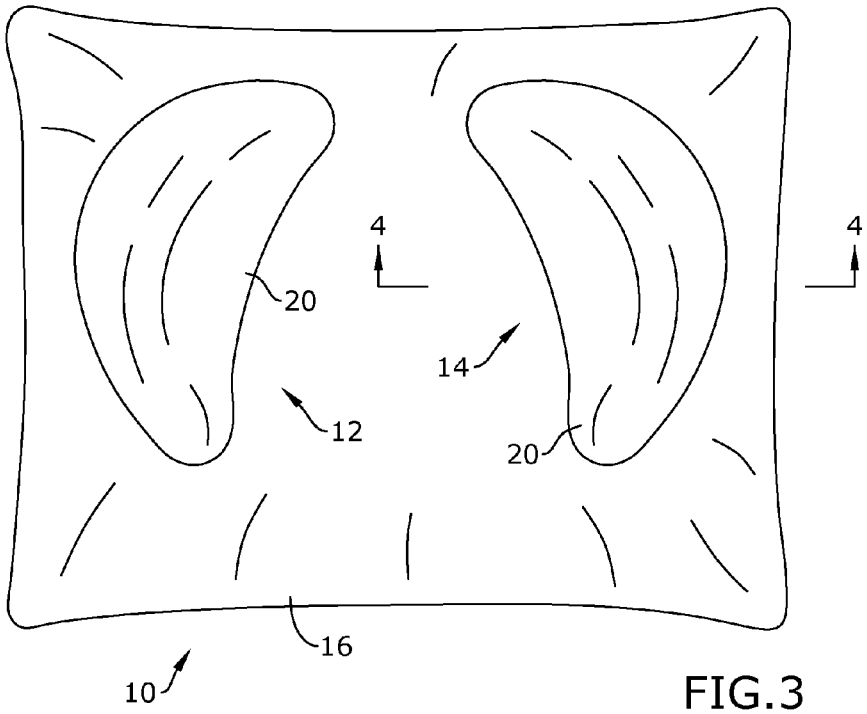
FIG. 3: is a top view of an embodiment of the pillow.
Figure 4:
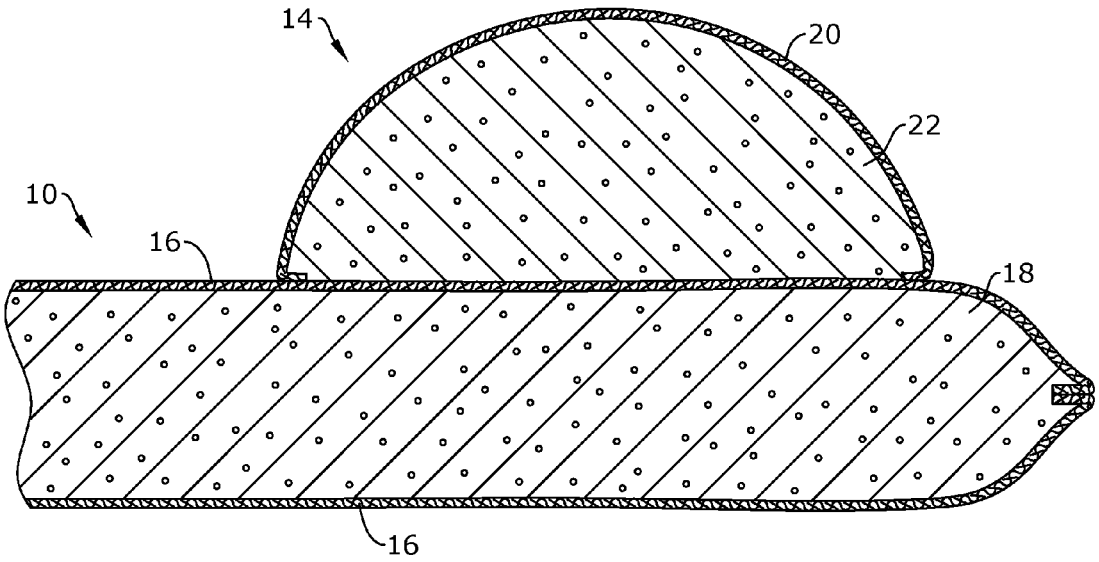
FIG. 4: is a section view of the pillow, taken along line 4-4 in FIG. 3

As may be seen in reference to FIGS. 3-4, the base pillow filler 18 is covered with a fabric covering 16, preferably 100% cotton fiber material, though other suitable pillow fabric coverings may also be utilized. The base pillow filler 18 is preferably comprised of a down alternative microfiber material that may be laminated to be down proof.

Similarly, the crescent-shaped head and neck supports 12, 14 are preferably formed of a filler material 22 comprised of down alternative microfiber, which likewise may be laminated to be down proof. The filler material 22 for the head and neck supports 12 & 14 is also covered with a pillow fabric material 20, which is preferably a 100% cotton fiber material, though other fabrics may also be suitable.

The head and neck supporting crescents 12 & 14 define a space between which the head and neck are supported. The crescents 12 and 14 may have an elevation so as not block off the user's ear openings, and in any event below a lateral hairline of the user so as not to contact the user's face. The lower points of the crescents 12 & 14 are disposed so that they touch the base of the head near the hairline under the neck or so that they are generally aligned with a line extending downwardly from the chin. The upper points of the crescents 12 & 14 are disposed at the sides of and near the top of the user's head. The head and neck supporting crescents 12 & 14 support and cradle the head, while allowing the face to be totally untouched by the pillow 10. As will be appreciated, the crescents 12 & 14 that affix to the base pillow 10 cradle the user's head so as to form both an anchor and cushion for the head and neck.

In the preferred use of the head cradle 10 of the present invention, the user would identify the top surface of the cradle 10, as indicated by the surface on which the supporting crescents 12 & 14 are located. Once the user has identified the top of the head cradle 10 and has it correctly in place at a location where they wish to sleep on it, they would lay down on their back, sweep your hair away from your neck and allow it to flow over the top end of the cradle 10 before placing their head within the crescents 12 & 14. When the user's head 26 and hair 28 are in place, they should grasp the bottom corners of the cradle base 10 and guide them to rest at the tops of their shoulders, all while keeping their head within the crescents 12 & 14. Wiggle within the cradle and pull the crescents 12 & 14 away from their ears until their head feels settled and comfortable. This will help secure them into position, without feeling like their head is in a vise. In this position, it will give the user's neck ample room to be comfortably supported, as well as help the base cradle 10 conform to the user's personal fit.

As will be appreciated, the head cradle 10 of the present invention may also be utilized alone or with an additional pillow for added elevation and neck support based on the user's desired comfort level.

Figure 5:
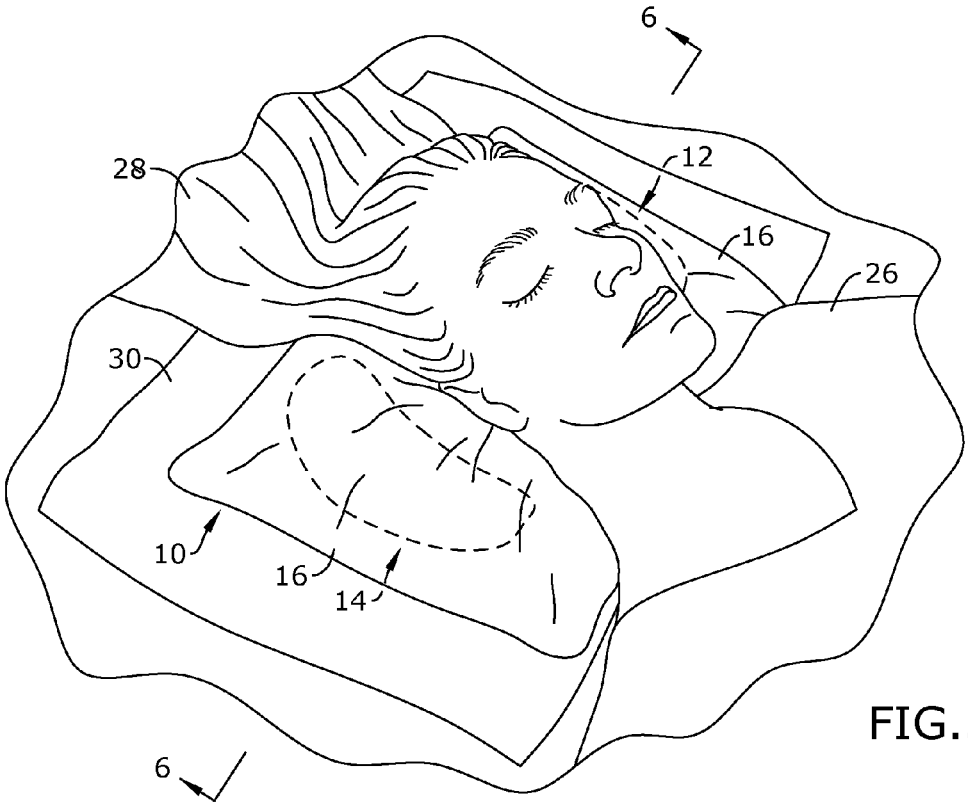
FIG. 5: is a perspective view of the pillow, shown in use in the alternate ((hammock" position and on top of an existing pillow 30.
Figure 6:
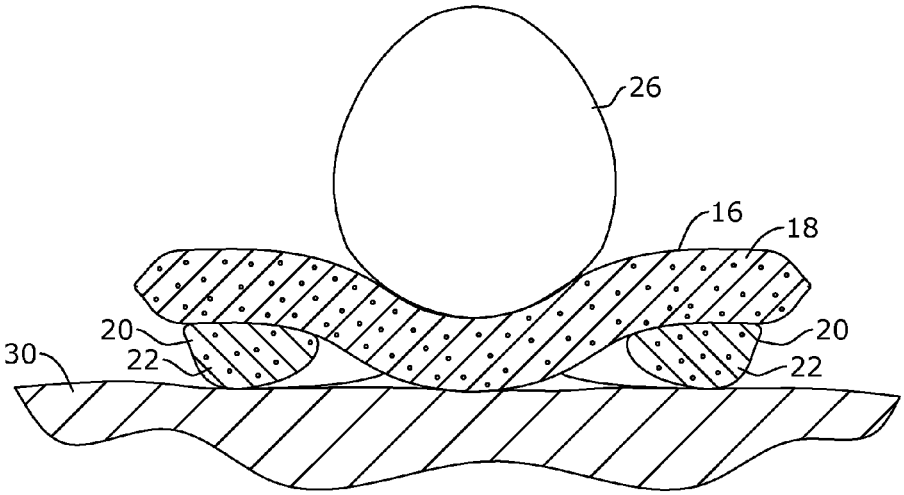
FIG. 6: is a section view of the pillow, taken along line 6-6 in FIG. 5

As seen in reference to FIGS. 5 and 6, the head cradle 10 may be utilized in an inverted position, with the crescents 12 & 14 positioned face down. This position has been found desirable for users with very thick volumes of hair, or perhaps a larger diameter head. Using head cradle 10 with the crescents 12 & 14 face-down will create a comfortable head hammock for those with heavier, larger heads. As long as the crescents are at the top surface of the underlying traditional pillow, even face-down, the user can't go wrong.

The Back to Beauty Anti-Wrinkle Head Cradle is designed to cradle the head rather than be just a pillow that is not active in securing the user's head in place and protecting their face from undesired contact with the pillow at all times.

The medical field both for plastic cosmetic surgery and dental surgeons can recommend the use the Back to Beauty Anti-Wrinkle Head cradle to their patients to aid in the recovery of surgical work they have done. The surgeon would not want their patients sleeping on their face post-surgery, and the Back to Beauty Anti-Wrinkle Head Cradle would be very helpful to them and their patients. Dermatologists needing patients to keep the bacteria from their pillow from touching their will also find the Back to Beauty Anti-Wrinkle Head Cradle a helpful aid in treating patients.

It should be understood, of course, that the foregoing relates to exemplary embodiments of the invention and that modifications may be made without departing from the spirit and scope of the invention as set forth in the following claims.

What is claimed is:

1. A head cradle pillow comprising:

a substantially flat base pillow containing a volume of filler material; and a pair of opposed crescent shaped support members are disposed in a spaced apart relation to define a head cradle on an upper surface of the base pillow, wherein an intermediate portion of the crescent shaped support members is elevated above a lower point and an upper point of the of the crescent shaped support members.

2. The head cradle pillow of claim 1, wherein the base pillow is comprised of a down alternative microfiber material.

3. The head cradle pillow of claim 2, wherein the down alternative microfiber material is laminated with a down proof material.

4. The head cradle pillow of claim 1, wherein the crescent shaped support members are comprised of a down alternative microfiber material.

5. The head cradle pillow of claim 4, wherein the down alternative microfiber material is laminated with a down proof material.

6. The head cradle pillow of claim 1, wherein the base pillow and crescent shaped support members are covered with a fabric material.

7. The head cradle pillow of claim 6, wherein the fabric material is 100% cotton.

8. The head cradle pillow of claim 7, wherein the crescent shaped support members have an elevation that is configured to be below the user's ear opening.

9. The head cradle pillow of claim 1, wherein a lower point of the crescent shaped support members is configured to be defined proximal to a hair line at the nape of a user's head.

10. The head cradle pillow of claim 9, wherein an upper point of the crescent shaped support members are configured to be defined proximal to the top of a user's head.

11. A head cradle pillow comprising:

a substantially flat base pillow containing a volume of filler material; and a pair of opposed crescent shaped support members are disposed in a spaced apart relation to define a head cradle on an upper surface of the base pillow, wherein the head cradle is configured to circumscribe a portion of a user's head received therein, a lower point of the crescent shaped support members are configured to be defined proximal to a hair line at the nape of the user's neck, and an upper point of the crescent shaped support members are configured to be defined proximal to a crown of the user's head, wherein an intermediate portion of the crescent shaped support members is elevated above the lower point and the upper point of the of the crescent shaped support members.

12. The head cradle pillow of claim 11, wherein the base pillow is comprised of a down alternative microfiber material.

13. The head cradle pillow of claim 12, wherein the down alternative microfiber material is laminated with a down proof material.

14. The head cradle pillow of claim 11, wherein the crescent shaped support members are comprised of a down alternative microfiber material.

15. The head cradle pillow of claim 14, wherein the down alternative microfiber material is laminated with a down proof material.

16. The head cradle pillow of claim 11, wherein the base pillow and crescent shaped support members are covered with a fabric material.

17. The head cradle pillow of claim 16, wherein the fabric material is 100% cotton.

* * * * *